US005330589A

United States Patent [19]

Cheng et al.

[11] Patent Number: 5,330,589

[45] Date of Patent: Jul. 19, 1994

[54] HAFNIUM ALLOYS AS NEUTRON ABSORBERS

[75] Inventors: Boching Cheng, Cupertino; Rosa L. Yang, Los Altos, both of Calif.

[73] Assignee: Electric Power Research Institute, Palo Alto, Calif.

[21] Appl. No.: 67,325

[22] Filed: May 25, 1993

[51] Int. Cl.[5] ..... C22C 27/00

[52] U.S. Cl. ..... 148/421; 420/422; 148/668; 376/353; 376/219; 376/239

[58] Field of Search ..... 420/422; 148/421, 668; 376/353, 219, 239

[56] References Cited

U.S. PATENT DOCUMENTS

| | | | |
|---|---|---|---|
| 3,505,064 | 4/1970 | Mock et al. | 75/134 |
| 3,515,544 | 6/1970 | Morton et al. | 75/134 |
| 3,957,507 | 5/1976 | Blumenthal et al. | 75/134 |
| 4,722,827 | 2/1988 | Kwon | 420/422 |
| 4,992,240 | 2/1991 | Komatsu et al. | 420/422 |
| 5,017,336 | 5/1991 | Matsuo et al. | 420/422 |
| 5,032,196 | 7/1991 | Masumoto et al. | 148/403 |
| 5,064,607 | 11/1991 | Miller et al. | 376/333 |
| 5,112,573 | 5/1992 | Foster et al. | 420/422 |
| 5,118,468 | 6/1992 | Boutin et al. | 419/66 |
| 5,125,985 | 6/1992 | Foster et al. | 148/672 |

FOREIGN PATENT DOCUMENTS

| | | |
|---|---|---|
| 60-166865 | 8/1985 | Japan . |
| 60-173405 | 9/1985 | Japan . |
| 62-164863 | 7/1987 | Japan . |

*Primary Examiner*—Melvyn J. Andrews
*Assistant Examiner*—Sean Vincent
*Attorney, Agent, or Firm*—Heller, Ehrman, White & McAuliffe

[57] ABSTRACT

A hafnium alloy consisting essentially of hafnium and containing Sn by 0.1–1.5 weight %, O by 0.03–0.2 weight %, Fe by 0.01–0.15 weight %, Zr by 0.02–2.0 weight %, and (1) Cr by 0.01–0.15 weight %, and Ni by less than 0.10 weight %, (2) Cr by 0.01–0.15 weight %, Ni by less than 0.10 weight %, and Mo by 0.01–0.2 weight %, (3) Nb by 0.2–1.0 weight %, or (4) Nb by 0.2–1.0 weight %, and Mo by 0.01–0.2 weight % has high neutron-absorbing capacity, high resistance to uniform and nodular corrosion, high tensile and creep strength, and good wear resistance, and is suited to be used as neutron absorber for nuclear power reactors.

8 Claims, No Drawings

HAFNIUM ALLOYS AS NEUTRON ABSORBERS

BACKGROUND OF THE INVENTION

This invention relates to hafnium alloys to be employed, for example, as neutron absorbers for nuclear power reactors.

Neutron absorbers in control rod forms are used in nuclear power reactors to control or regulate nuclear reactions. Boron carbide ($B_4C$) are used in both pressurized and boiling water reactors (PWRs and BWRs). Silver-indium-cadmium (AgInCd) is also commonly used in PWRs. Pellets of $B_4C$ or AgInCd are canned in thin-wall stainless steel cladding of approximately 14 feet for PWR applications. Operational experience, however, indicates several shortcomings of the stainless steel canned control rod designs. Brittle cracking of the stainless steel clad due to swelling of $B_4C$ or AgInCd, particularly near the tips of the control rod assemblies, has been experienced commonly in both BWRs and PWRs. Wears of the stainless steel clad have been frequently observed at locations in contact with the control rod guide cards in PWRs. Bending of the long control rods in PWRs has been experienced during handling. Both brittle cracking and wear can lead to cladding perforation and breach of the neutron absorbers into the reactor coolant system (RCS) and significantly reduce the control rod lifetime. Rod bending is due to use of small thin-wall cladding and can lead to premature discharge of the control rod.

More recently, high-purity hafnium has been used in both PWRs and BWRs as an alternative neutron absorber. In PWRs, high-purity hafnium rod segments are canned in thin-wall stainless steel cladding. Experience with the hafnium control rods, however, has been dismal due to swelling of the hafnium, as caused by localized massive hydriding, and plans are in place to remove all stainless steel canned hafnium control rods still in PWRs. High-purity hafnium control rods in short segments are in use in unclad forms in BWRs. Past experience with zirconium, the sister metal of hafnium, and its alloys suggests that optimization of hafnium corrosion resistance may be needed in order to achieve long design life.

SUMMARY OF THE INVENTION

An object of the present invention is to provide new hafnium alloys having high neutron-absorbing capacity, high resistance to uniform and nodular corrosion, high tensile and creep strength, and good wear resistance, such that they can serve as neutron absorbers for nuclear power reactors.

Hafnium alloys according to the present invention, with which the above and other objects can be accomplished, may be characterized as being a high-purity hafnium alloy containing experimentally determined minimum amounts of specified elements such as Sn, O, Fe and Zr for increasing tensile and creep strength, corrosion resistance, hardness, wear resistance and machinability. The alloys of the present invention are further characterized as receiving a final annealing or stress-relief treatment at the temperature range of 500°-900° C. so as to be in recrystallized or stress-relieved form.

DETAILED DESCRIPTION OF THE INVENTION

There will be described below four hafnium alloys embodying the present invention, designated respectively as Hafaloy, Hafaloy-M, Hafaloy-N, and Hafaloy-NM. Their alloy compositions (in weight %) are as shown in Table I below. In Table I, elements not listed are considered impurities, and the limits for the impurities are to be within the nominal specifications for reactor-grade hafnium.

TABLE I

| Element | Hafaloy | Hafaloy-M | Hafaloy-N | Hafaloy-NM |
|---|---|---|---|---|
| Sn | 0.1-1.5 | 0.1-1.5 | 0.1-1.5 | 0.1-1.5 |
| O | 0.03-0.2 | 0.03-0.2 | 0.03-0.2 | 0.03-0.2 |
| Fe | 0.01-0.15 | 0.01-0.15 | 0.01-0.15 | 0.01-0.15 |
| Cr | 0.01-0.15 | 0.01-0.15 | — | — |
| Ni | <0.10 | <0.10 | — | — |
| Nb | — | — | 0.2-1.0 | 0.2-1.0 |
| Mo | — | 0.01-0.2 | — | 0.01-0.2 |
| Zr | 0.02-2.0 | 0.02-2.0 | 0.02-2.0 | 0.02-2.0 |
| Hf | Balance | Balance | Balance | Balance |

Addition of Sn and O are for increasing the tensile and creep strength. Fe, Cr and Nb are added for corrosion resistance, and Mo is added for hardness, wear resistance and machinability. If Sn, O and/or Nb is added in excess of the upper limit shown in Table I, however, the alloy becomes too hard. Addition of too much Fe, Cr, Ni and/or Mo causes precipitation of small particles. Although hafnium-base alloys according to U.S. Pat. No. 3,515,544 are allowed to contain up to about 4% of zirconium, zirconium content according to the present invention is less than 2% because excessive presence of zirconium affects the properties of the alloy adversely, degrading the corrosion resistance of hafnium.

The Hafaloys of the present invention are produced from ingots which have undergone at least double-melting. Subsequent to a thermomechanical process for forming the final product, the Hafaloys are subjected to a final annealing or stress-relief treatment at the temperature range of 500°-900° C. and are in recrystallized or stress-relieved form. The Hafaloys, thus produced, have high neutron-absorbing capacity, high resistance to uniform and nodular corrosion in power reactors, high tensile and creep strength, and good wear resistance. They form a protective oxide in water reactors, substantially increasing the wear resistance against steel-based components. They also possess excellent resistance to hydriding due to the protective surface oxide, thereby eliminating hydride bulge. Their combined attributes of neutron absorption, corrosion resistance, hydriding resistance, strength, and wear resistance make them suitable for use as a structural material in unclad form for long-life control rods in both PWRs and BWRs to alleviate wear damage and cladding cracking and associated loss of absorber material. The superior corrosion resistance prevents oxide spallation in long-life control rod design. The high strength of the Hafaloys minimizes rod damage due to bending. It goes without saying that they can also be used in tube and sheet forms as neutron absorbers.

What is claimed is:

1. A hafnium alloy consisting of 0.1-1.5% Sn by weight, 0.03-0.2% O by weight, 0.01-0.15% Fe by weight, 0.01-0.15% Cr by weight, less than 0.10% Ni by weight, 0.02–2.0% Zr by weight, the balance being Hf and impurities.

2. The hafnium alloy of claim 1 which is annealed at 500°–900° C. and is in recrystallized or stress-relieved form.

3. A hafnium alloy consisting of 0.1–1.5% Sn by weight, 0.03–0.2% O by weight, 0.01–0.15% Fe by weight, 0.01–0.15% Cr by weight, less than 0.10% Ni by weight, 0.01–0.2% Mo by weight, 0.02–2.0% Zr by weight, the balance being Hf and impurities.

4. The hafnium alloy of claim 3 which is annealed at 500°–900° C. and is in recrystallized or stress-relieved form.

5. A hafnium alloy consisting of 0.1–1.5% Sn by weight, 0.03–0.2% O by weight, 0.01–0.15% Fe by weight, 0.2–1.0% Nb by weight, 0.02–2.0% Zr by weight, the balance being Hf and impurities.

6. The hafnium alloy of claim 5 which is annealed at 500°–900° C. and is in recrystallized or stress-relieved form.

7. A hafnium alloy consisting of 0.1–1.5% Sn by weight, 0.03–0.2% O by weight, 0.01–0.15% Fe by weight, 0.2–1.0% Nb by weight, 0.01–0.2% Mo by weight, 0.02–2.0% Zr by weight, the balance being Hf and impurities.

8. The hafnium alloy of claim 7 which is annealed at 500°–900° C. and is in recrystallized or stress-relieved form.

* * * * *